US008309289B2

(12) United States Patent
Anno et al.

(10) Patent No.: US 8,309,289 B2
(45) Date of Patent: Nov. 13, 2012

(54) ELECTROSTATIC CHARGE IMAGE DEVELOPING TONER, ELECTROSTRATIC CHARGE IMAGE DEVELOPER, TONER CARTRIDGE, PROCESS CARTRIDGE, AND IMAGE FORMING APPARATUS

(75) Inventors: Shintaro Anno, Kanagawa (JP); Yoshifumi Iida, Kanagawa (JP); Yutaka Saito, Kanagawa (JP); Masaru Takahashi, Kanagawa (JP); Toshiyuki Yano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 442 days.

(21) Appl. No.: 12/727,848

(22) Filed: Mar. 19, 2010

(65) Prior Publication Data

US 2011/0065035 A1 Mar. 17, 2011

(30) Foreign Application Priority Data

Sep. 14, 2009 (JP) ..... 2009-211938

(51) Int. Cl.
*G03G 9/08* (2006.01)

(52) U.S. Cl. ..... 430/108.11; 430/108.7; 399/252

(58) Field of Classification Search ..... 430/108.11, 430/108.7; 399/252
See application file for complete search history.

(56) References Cited

U.S. PATENT DOCUMENTS

| | | | |
|---|---|---|---|
| 2,297,691 | A | 4/1939 | Carlson |
| 2,357,809 | A | 11/1940 | Carlson |

FOREIGN PATENT DOCUMENTS

| | | |
|---|---|---|
| JP | A-60-79361 | 5/1985 |
| JP | A-60-166957 | 8/1985 |
| JP | A-64-49052 | 2/1989 |
| JP | A-2000-305311 | 11/2000 |
| JP | A-2007-178869 | 7/2007 |
| WO | WO 2008/069599 A1 | 6/2008 |

OTHER PUBLICATIONS

European Search Report issued in European Patent Application No. 10157332.7 dated Dec. 22, 2010.

*Primary Examiner* — Mark A Chapman
(74) *Attorney, Agent, or Firm* — Oliff & Berridge, PLC

(57) ABSTRACT

An electrostatic charge image developing toner including: toner particles including a binder resin and a colorant; polytetrafluoroethylene particles in which a content of perfluorooctanoic acid and a salt thereof is 0.5 ppm or less; and silica particles in which a content of water is from 0.1% by weight to 10% by weight at an ambient temperature of 20° C. and an ambient humidity of 20%.

18 Claims, 2 Drawing Sheets

ELECTROSTATIC CHARGE IMAGE DEVELOPING TONER, ELECTROSTRATIC CHARGE IMAGE DEVELOPER, TONER CARTRIDGE, PROCESS CARTRIDGE, AND IMAGE FORMING APPARATUS

CROSS-REFERENCE TO RELATED APPLICATION

This application is based on and claims priority under 35USC 119 from Japanese Patent Application No. 2009-211938, filed Sep. 14, 2009.

BACKGROUND

1. Technical Field

The present invention relates to an electrostatic charge image developing toner, an electrostatic charge image developer, a toner cartridge, a process cartridge, and an image forming apparatus.

2. Related Art

An electrophotography system which visualizes an image information by way of an electrostatic latent image is utilized presently in various fields (see, for example, U.S. Pat. Nos. 2,297,691 and 2,357,809). In an electrophotography system, a permanent image is obtained generally through the following processes: a charging and exposing process in which an electrostatic latent image is formed on the surface of a photoreceptor; a development process in which the electrostatic latent image is developed, by using an electrostatic charge image developer that contains an electrostatic charge image developing toner, so as to form a toner image; a transfer process in which the toner image is transferred onto a transferring member such as paper or a sheet; and a fixing process in which the toner image is fixed onto the transferring member by using heat, solvent, pressure, or the like. After the toner image is transferred onto a surface of a recording medium, the photoreceptor is subjected to cleaning.

SUMMARY

According to an aspect of the invention, there is provided an electrostatic charge image developing toner including:

toner particles including a binder resin and a colorant;

polytetrafluoroethylene particles in which a content of perfluorooctanoic acid and a salt thereof is 0.5 ppm or less; and silica particles in which a content of water is from 0.1% by weight to 10% by weight at an ambient temperature of 20° C. and an ambient humidity of 20%.

BRIEF DESCRIPTION OF THE DRAWINGS

Exemplary embodiment will be described in detail based on the following figures, wherein.

DETAILED DESCRIPTION

Figure 1:
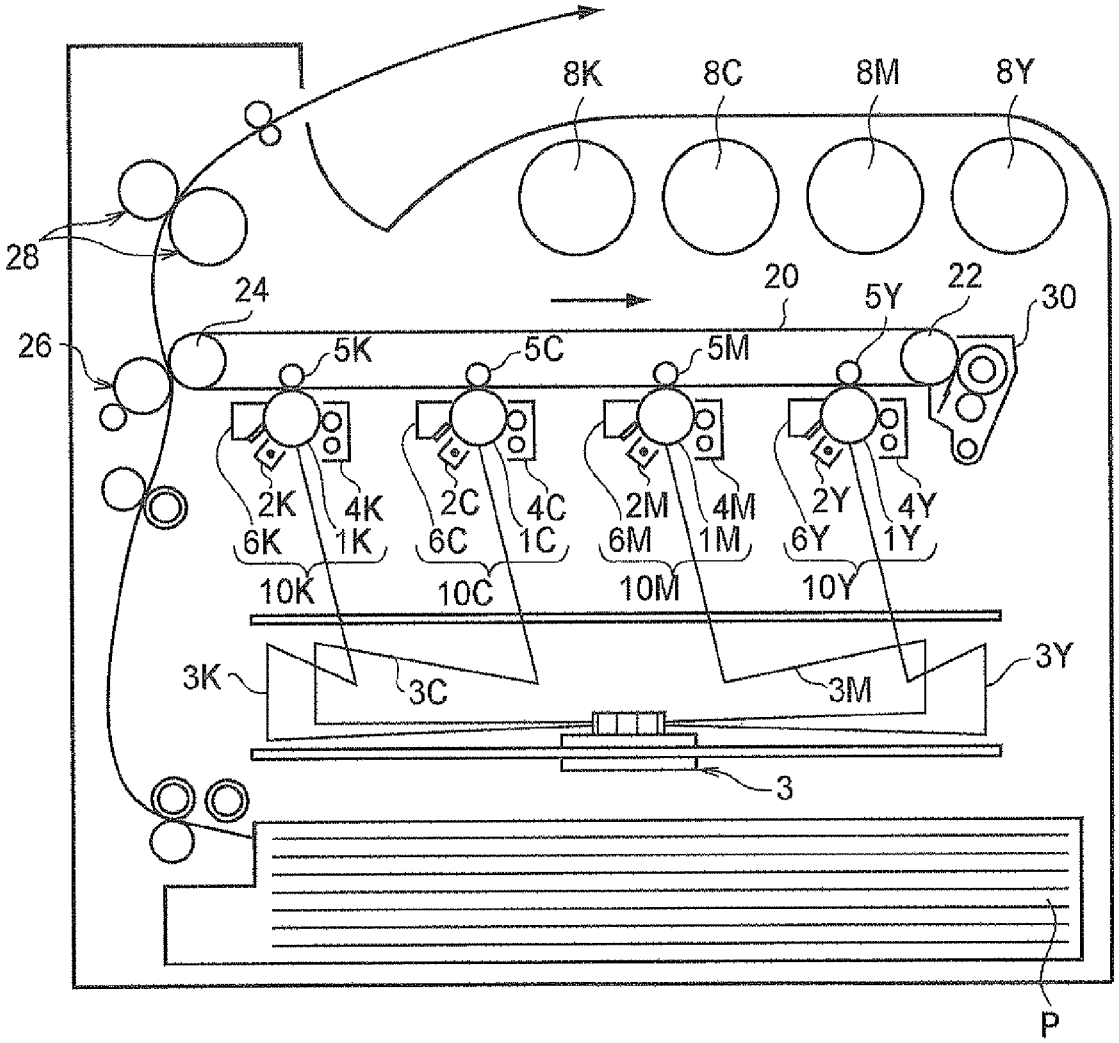
FIG. 1 is a schematic configurational diagram showing an example of an image forming apparatus according to an exemplary embodiment of the present invention.

An exemplary embodiment of the present invention is described in detail below.

(Toner for Development of Electrostatic charge image)

An electrostatic charge image developing toner according to the exemplary embodiment (hereinafter, simply referred to as "toner" in some cases) includes:

toner particles including a binder resin and a colorant;

polytetrafluoroethylene particles having a content of perfluorooctanoic acid (hereinafter also referred to as "PFOA" in some cases) of 0.5 ppm or less (hereinafter referred to as "specific PTFE particles" in some cases); and silica particles having a content of water of from 0.1% by weight to 10% by weight at an ambient temperature of 20° C. and an ambient humidity of 20% (hereinafter sometimes referred to as "specific silica particles"). The above content of perfluorooctanoic acid refers to the total content of perfluorooctanoic acid and salts thereof, and the same applies hereinafter.

Both of the specific PTFE particles and the specific silica particles according to the exemplary embodiment are particles used as external additives.

When a cleaning blade system is used for cleaning a latent image holding member (hereinafter also referred to as "photoreceptor" in some cases), the toner, external additives contained in the toner, and the like form a solid accumulated matter (hereinafter also referred to as "dam" in some cases) at the tip of the nip portion of the cleaning blade, and the photoreceptor is abraded in accordance with a balance between the dam and the sliding property imparted by a lubricant. The cleaning performance of the cleaning blade is obtained due to the abrasion of the photoreceptor. A liquid cross-linking force due to adsorbed water on the surface of an external additive such as silica particles is considered to be one of major factors for the formation of the dam. However, when printing is performed continuously at a low humidity (15% RH), the tendency toward dam formation weakens, and the amount of adhered matter on the photoreceptor increases, as a result of which the photoreceptor is not abraded uniformly by cleaning in some cases.

Although the dam thus formed should retain a certain amount of water therein, an excessively high content of water results in an excessive increase in adhesion power among the toner particles and a decrease of toner agitation in the nip portion, whereby, in some cases, the abrasion amount of the photoreceptor is increased in an image portion where the toner is concentrated.

When the cleaning blade system is used, constituent components of the toner form deposits at a contact portion (hereinafter also referred to as "nip portion" in some cases) between the cleaning blade and the photoreceptor, and are hardly agitated. Consequently, uneven abrasion is caused by an increase of the nip pressure in an image portion, in some cases.

As opposed to the above, when polytetrafluoroethylene particles (PTFE particles) are externally added to toner particles, the PTFE particles, having a low frictional coefficient due to the material thereof, reduces friction between the toner particles and the photoreceptor surface and suppresses adherence between the toner particles. The reason therefor is considered to be as follow: the PTFE particles adhered unevenly onto the surface of the toner particles deposited on the nipped portion prevent adherence between the toner particles and allow the toner particles to be agitated, whereby the photoreceptor is considered to be uniformly abraded while the cleaning performance is held and the nip pressure is not increased.

However, perfluorooctanoic acid (PFOA) that is used in the production of the PTFE particles remains in the PTFE particles in some cases. In a case in which the PTFE particles are externally added to the toner particles, the perfluorooctanoic acid which separates from the PTFE particles when the perfluorooctanoic acid is condensed at the nip portion of the blade adheres onto a portion such as toner or the surface of the photoreceptor, and removes the adsorbed water retained by the dam that is formed from the external additives. As a result, the cleaning performance decreases, and the amount of the deposit on the photoreceptor increases in some cases.

In contrast, it is presumed that in the toner according to the exemplary embodiment, the inclusion of silica particles (specific silica particles) having a water content of from 0.1% by weight to 10% by weight at a temperature of 20° C. and a humidity of 20% as an external additive makes it possible to effectively form a solid dam from the external additive. In addition, the inclusion of polytetrafluoroethylene particles (specific PTFE particles) having a perfluorooctanoic acid (PFOA) content of 0.5 ppm or less is presumed to make it difficult to remove the adsorbed water retained in the dam that is formed from the external additive. Further, it is surmised that, in the nip portion, since the specific PTFE particles adhere selectively to a region having a high water content, the adhesive force between the toner particles is decreased and maintains sufficient agitation of the toner.

In the following, details of the components that form the toner of the exemplary embodiment are described in order.

Toner Particles

The toner particles include a binder resin and a colorant, and may further include a release agent as necessary.

The toner particles may be produced by a known method, and examples thereof include: a kneading and pulverizing method in which a binder resin, a colorant and, optionally, a release agent, a charge controller, and the like are kneaded, pulverized, and classified; a method in which the shape of the particles obtained by the kneading and pulverizing method is changed by a mechanical impact or thermal energy; an emulsion polymerization aggregation method in which a dispersion liquid obtained by emulsion polymerizing a polymerizable monomer for forming a binder resin and a dispersion liquid of a colorant, a release agent, and, optionally, a charge controller and the like are blended, aggregated, heated and fused to obtain toner particles; a suspension polymerization method in which a polymerizable monomer for forming a binder resin and a solution of a colorant, a release agent, and, optionally, a charge controller and the like are suspended in an aqueous solvent and polymerized; and a dissolution suspension method in which a binder resin and a solution of a colorant, a release agent, and, optionally, a charge controller and the like are suspended in an aqueous solvent and granulated.

Furthermore, the toner particles may be produced according to a production method in which aggregated particles are adhered onto the particles obtained above as a core, and fused by heating to form a core-shell structure.

Among these methods, the toner particles are produced preferably by the suspension polymerization method, the emulsion polymerization aggregation method, or the dissolution suspension method, each of which involves production of toner particles in an aqueous solvent, from the viewpoints of shape control and controlling a particle size distribution. The toner particles are produced more preferably by the emulsion polymerization aggregation method.

When the toner particles are produced by a wet method, among various kinds of materials described below, it is preferable to select and use a material that is scarcely soluble in water from the viewpoints of controlling the ionic strength and reducing contamination of wastewater.

Binder Resin

Examples of the binder resin include homopolymers or copolymers of the following: styrenes such as styrene or chlorostyrene; mono-olefins such as ethylene, propylene, butylene, or isoprene; vinyl esters such as vinyl acetate, vinyl propionate, vinyl benzoate, or vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, or dodecyl methacrylate; vinyl ethers such as vinyl methyl ether, vinyl ethyl ether, or vinyl butyl ether; vinyl ketones such as vinyl methyl ketone, vinyl hexyl ketone, or vinyl isopropenyl ketone. In particular, typical binder resins include: polystyrene, a copolymer of styrene and alkyl acrylate, a copolymer of styrene and alkyl methacrylate, a copolymer of styrene and acrylonitrile, a copolymer of styrene and butadiene, a copolymer of styrene and maleic anhydride, polyethylene, and polypropylene.

Besides the above, further examples of the binder resin include polyester, polyurethane, epoxy resin, silicone resin, polyamide, denatured rosin, and paraffin wax.

Colorant

Typical examples of the colorant include magnetic powders such as magnetite or ferrite, carbon black, Aniline Blue, Chalcoyl Blue, Chrome Yellow, ultramarine blue, Dupont oil red, quinoline yellow, Methylene Blue chloride, phthalocyanine blue, Malachite Green oxalate, lamp black, Rose Bengale, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, and C. I. Pigment Blue 15:3.

Release Agent

Typical examples of the release agent include low-molecular polyethylene, low-molecular polypropylene, Fisher-Tropsch wax, montan wax, carnauba wax, rice wax, and candelilla wax.

Other Components

A charge controller may be added to the toner particles as necessary.

The charge controller may be a known charge controller. Specific examples thereof include an azo-based metal complex compound, a metal complex compound of salicylic acid, and a resin-type charge controller having a polar group.

A lubricant may be contained in the toner particles.

Examples of the lubricant include: solid lubricants such as graphite, molybdenum disulfide, talc, fatty acids, and fatty acid metal salts; fatty acid amides such as oleamide, erucamide, ricinoleamide, and stearamide; vegetable waxes such as carnauba wax, rice wax, candelilla wax, Japanese wax, and jojoba oil; animal waxes such as bees wax; mineral or petroleum waxes such as montan wax, ozokerite, ceresin, paraffin wax, microcrystalline wax, and Fisher-Tropsch wax; and modified products thereof. The lubricant may be used singly, or in combination of two or more thereof.

For the purpose of removing deposits and degraded materials from the surface of an electrophotographic photoreceptor, inorganic particles, organic particles, or composite particles formed by adhering inorganic particles to organic particles may be added to the toner particles. Inorganic particles, which are excellent in abrasion properties, are preferable.

Examples of the inorganic particles include various inorganic oxides, nitrides, carbides, and borides, and specific examples thereof include silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

The inorganic particles may be treated with a titanium coupling agent, a silane coupling agent, or the like. Examples of the titanium coupling agent include tetrabutyl titanate, tetraoctyl titanate, isopropyl triisostearoyl titanate, isopropyl tridecyl benzenesulfonyl titanate, and bis(dioctylpyrophosphate) oxyacetate titanate. Examples of the silane coupling agent include γ-(2-aminoethyl)aminopropyl trimethoxy silane, γ-(2-aminoethyl)aminopropyl methyl dimethoxy silane, γ-methacryloxypropyl trimethoxy silane, N-β-(N-vinylbenzylaminoethyl)-γ-aminopropyl trimethoxy silane hydrochlorate, hexamethyl disilazane, methyl trimethoxy silane, butyl trimethoxy silane, isobutyl trimethoxy silane, hexyl trimethoxy silane, octyl trimethoxy silane, decyl trimethoxy silane, dodecyl trimethoxy silane, phenyl trimethoxy silane, o-methylphenyl trimethoxy silane, and p-methylphenyl trimethoxy silane.

The toner particles may be magnetic toner particles that include a magnetic material therein or non-magnetic toner particles that do not include a magnetic material therein.

The volume average particle diameter of the toner particles is preferably from 2 μm (or about 2 μm) to 12 μm (or about 12 μm), and more preferably from 3 μm (or about 3 μm) to 9 μm (or about 9 μm). When the particle diameter of the toner particles is 2 μm or more, the toner particles have favorable fluidity and sufficient chargeability of each particle is obtained; in addition, because the charge distribution of the toner particles is narrow, background fogging, escaping of the toner from a developing unit, and the like are prevented, and, further, sufficient cleaning properties are obtained. When the particle diameter is 12 μm or less, a favorable resolution and favorable image quality are obtained, and recent demands for higher image quality are fulfilled.

The following method is used for the measurement of the volume average particle diameter of the toner particles.

The particle diameters are measured using a COULTER MULTISIZER-II (trade name, manufactured by Beckman Coulter, Inc.) as a measurement apparatus, and using an electrolytic solution ISOTON-II (trade name, manufactured by Beckman Coulter, Inc).

In the measurement method, a measurement sample in an amount of from 0.5 mg to 50 mg is added to 2 mL of an aqueous solution containing 5% of a surfactant, such as sodium alkylbenzene sulfonate, which serves as a dispersant; the resulting solution is added to the above electrolytic solution having a volume of from 100 mL to 150 mL; the electrolytic solution in which the measurement sample is suspended is subjected to a dispersing treatment for about 1 minute by using an ultrasonic disperser; and then a particle size distribution of particles having a particle diameter of from 2.0 μm to 60 μm is measured by using the above COULTER MULTISIZER-II with an aperture having an aperture diameter of 100 μm. The number of particles to be measured is 50,000.

Based on the number of particles for each of the divided particle size ranges (channels) obtained from the thus measured particle diameters, a cumulative distribution is drawn from the smaller diameter side with respect to each of the particle volume and the particle number. The particle diameter at which the cumulative volume distribution reaches 50% of the total volume is defined as a volume average particle diameter D50v, and the particle diameter at which the cumulative number distribution reaches 50% of the total number is defined as a number average particle diameter D50p. Neither of the volume average particle diameter of the toner nor the particle size distribution of the toner is significantly changed by addition of external additives.

The toner particles may be spherical in shape with a shape factor SF1 of from 115 (or about 115) to 140 (or about 140). When the shape of the toner particles is in a spherical shape that has a shape factor in the above range, developing properties and transfer properties are enhanced and the fineness of an image increases, thereby providing an image with a higher image quality, The shape factor SF1 of the toner particles is preferably in the range of from 120 (or about 120) to 135 (or about 135).

The shape factor SF1 is obtained from the following Formula (1).

$$SF1=(ML^2/A)\times(\pi/4)\times 100 \qquad \text{Formula (1)}$$

In the Formula (1), ML represents the absolute maximum length of a toner particle, and A represents the projection area of the toner particle.

The SF1 is quantified generally by analyzing a microscope image or a scanning electron microscope (SEM) image with an image analyzer. The SF1 of particles may be calculated, for example, as described below.

That is, optical microscope images of particles scattered on a surface of a slide glass are inputted through a video camera into a LUZEX (trade name) image analyzer, the maximum lengths and projection areas of 100 particles are determined, the SF1 value of each particle is calculated according to the Formula (1), and the average values thereof is used as the SF1 value of the particles. The SF1 of toner particles is not significantly changed by addition of external additives.

External Additives

The toner according to the exemplary embodiment includes external additives.

The external additives include polytetrafluoroethylene particles (specific PTFE particles) having a perfluorooctanoic acid content of 0.5 ppm or less and silica particles (specific silica particles) having a water content of from 0.1% by weight to 10% by weight at a temperature of 20° C. and a humidity of 20%. Each of the two kinds of particles is externally added to be adhered onto, or separate from, the surface of the toner particles.

1. Polytetrafluoroethylene Particles (Specific PTFE Particles) Having a Perfluorooctanoic Acid Content of 0.5 ppm or Less The toner according to the exemplary embodiment includes, as an external additive, polytetrafluoroethylene particles (specific PTFE particles) that have a perfluorooctanoic acid content of 0.5 ppm or less.

The specific PTFE particles have a perfluorooctanoic acid content of 0.5 ppm or less, and are preferably free from perfluorooctanoic acid.

In the exemplary embodiment, the content of perfluorooctanoic acid in the specific PTFE particles is obtained according to the measurement method described below.

Measurement Method

About 0.2 g of the PTFE particles as a measurement sample is dissolved in acetone whose weight is 10 times as much as the weight of the measurement sample; the resulting acetone solution is dripped slowly onto water whose weight is about 2 times as much as the weight of the acetone solution. The resulting aqueous solution is subjected to quantitative analysis with LC/MS/MS ("3200 Q TRAP" (trade name) L/MS/MS system, manufactured by Applied Biosystems Japan Corp.).

The specific PTFE particles that have a perfluorooctanoic acid content of 0.5 ppm or less are obtained through an emulsion polymerization method in which no PFOA is used, or through a method in which perfluorooctanoic acid and a surfactant other than perfluorooctanoic acid are used in combination. The specific PTFE particles may alternatively be obtained through a method in which emulsion polymerization is performed by using perfluorooctanoic acid and then the resulting aqueous solution is extracted with a fluoroalkyl solvent, a method in which the above aqueous solution is contacted with a nonionic surfactant, or a method in which a supercritical fluid is used to remove perfluorooctanoic acid.

The average particle diameter of the specific PTFE particles is preferably from 100 nm (or about 100 nm) to 500 nm (or about 500 nm), and more preferably from 100 nm (or about 100 nm) to 300 nm (or about 300 nm).

The average particle diameter of the specific PTFE particles is measured as follows: 100 fields (at a magnification of 50,000 times) are observed with a scanning electron microscope (S-4700, manufactured by Hitachi, Ltd.), the particle diameter (the average of the length of the major axis and the length of the minor axis) of each of 1000 PTFE particles is determined; and the average of the obtained particle diameters is assumed to be the number average primary particle diameter of the PTFE particles.

The specific PTFE particles are produced by, for example, an emulsion polymerization method. As the specific PTFE particles, a commercially available product may be used; for example, LUBRON-L2 (trade name) manufactured by Daikin Industries, Ltd. is available.

In regard to the composition of the specific PTFE particles, the specific PTFE particles may be made of a homopolymer of tetrafluoroethylene. Nevertheless, the specific PTFE particles may contain components derived from one or more other monomers, such as vinylidene fluoride or monofluoroethylene, at a ratio of 10% by weight or less.

The specific PTFE particles are externally added to the toner of the exemplary embodiment, such that the specific PTFE particles are adhered onto, or separate from, the surface of the toner particles. When adhering the specific PTFE particles onto the surface of the toner particles, the specific PTFE particles may be added in a dry state onto the surface of the toner particles while a shearing force is applied thereto. More specifically, a device providing a high shearing force (for example, stirring with a high revolution speed by using a Henschel mixer) may be used.

The amount of the specific PTFE particles added to 100 parts by weight of the toner particles is preferably from 0.1 parts by weight (or about 0.1 parts by weight) to 1 part by weight (or about 1 part by weight), and more preferably from 0.1 parts by weight (or about 0.1 parts by weight) to 0.6 parts by weight (or about 0.6 parts by weight), from the viewpoint of reducing the adhesiveness of the toner particles.

2. Silica Particles Having A Water Content of from 0.1% by Weight to 10% by Weight (Specific Silica Particles)

The toner according to the exemplary embodiment includes, as an external additive, silica particles (specific silica particles) that have a water content of from 0.1% by weight to 10% by weight at an ambient temperature of 20° C. and an ambient humidity of 20%.

The water content of the specific silica particles at an ambient temperature of 20° C. and an ambient humidity of 20% is from 0.1% by weight (or about 0.1% by weight) to 10% by weight (or about 10% by weight), and more preferably from 1% by weight (or about 1% by weight) to 5% by weight (or about 5% by weight).

In the toner according to the exemplary embodiment, the water content of the specific silica particles is measured according to the method described below.

Measurement Method

The water content (percentage of water) of the silica particles is measured by direct titration according to the Karl Fischer method (using an automatic moisture meter KF-06 manufactured by Mitsubishi Kasei Co., Ltd.).

Silica fine particles in an environment having a temperature of 20° C. and a humidity of 20% for 17 hours, and then the silica fine particles as a sample are placed in a specialized threaded bottle with a packing. Separately, 10 μl of pure water is precisely weighed with a microsyringe, and the amount of water (mg) that corresponds to 1 ml of Karl Fisher reagent is determined from the titration amount of the reagent required to remove the pure water. From 100 mg to 200 mg of the silica fine particles are precisely weighed as a measurement sample, and are fully dispersed in a measurement flask for 5 minutes using a magnetic stirrer.

After the measurement sample is dispersed, measurement is started. From the titration amount (ml) of the Karl Fisher reagent required for the titration, the water content and the percentage of water are calculated according to the following Formulae. The obtained percentage of water is used as a Karl Fisher's water content.

$$\text{Water content (mg)} = \text{Amount of the consumed reagent (ml)} \times \text{Factor of the reagent (mgH}_2\text{O/ml)}$$

$$\text{Percentage of water (\%)} = [\text{Water content (mg)} / \text{Amount of sample (mg)}] \times 100$$

The following methods may be used to adjust the water content of the specific silica particles to be in the range of from 0.1% by weight to 10% by weight: a method of drying under reduced pressure by using a vacuum drier may be employed; and methods for humidification, such as a method of maintaining the silica particles for a certain length of time in an environment of high temperature and high humidity during the production thereof, a method of adding silica fine particles and water little by little into a mixing tank equipped with a stirrer and stirring weakly, or a method of storing the silica fine particles in an environment of high temperature and high humidity, for example at a temperature of 30° C. and a humidity of 80%.

The specific silica particles are not particularly limited as long as the water content of the silica particles as measured by the above measurement method is from 0.1% by weight to 10% by weight. The specific silica particles may be any kind of particles that include $SiO_2$ at least on the surface thereof. Examples of such particles include silica simple-substance particles and silica composite oxide particles (for example, mixed crystal particles of $SiO_2$ and $TiO_2$, $Al_2O_3$ or the like; or particles of $TiO_2$, $Al_2O_3$ or the like that are coated with $SiO_2$).

The specific silica particles may be gas-phase method silica particles or wet method silica particles. Examples of wet method silica particles include precipitation-method silica particles, gel-method silica particles, and sol-method silica particles.

The specific silica particles may be subjected to a hydrophobization treatment. The hydrophobization agent is not particularly limited. Examples of the hydrophobization agent include a silane coupling agent, a titanate-based coupling agent, an aluminum-based coupling agent, and silicone oil. Among these, treatment with silicone oil is preferable. The hydrophobization agent may be used singly, or, alternatively, two or more of hydrophobization agents may be used in combination.

The number average particle diameter of the specific silica particles is preferably from 0.005 μm (or about 0.005 μm) to 0.50 μm (or about 0.50 μm), and more preferably from 0.010 μm (or about 0.010 μm) to 0.30 μm (or about 0.30 μm).

The specific silica particles are contained in the toner of the exemplary embodiment in such a manner that the specific silica particles adhere onto the surface of the toner particles.

When adhering the specific silica particles onto the surface of the toner particles, the specific silica particles may be added in a dry state onto the surface of the toner particles while a shearing force is applied thereto. More specifically, a device providing a high shearing force (for example, stirring at a high revolution speed by using a Henschel mixer) may be used.

Regarding the ratio of the amount of the contained specific silica particles to the amount of the added polytetrafluoroethylene particles, the amount of the specific silica particles may be from 0.5 parts by weight (or about 0.5 parts by weight) to 30 parts by weight (or about 30 parts by weight), and more preferably from 1 part by weight (or about 1 part by weight) to 25 parts by weight (or about 25 parts by weight), with respect to 1 part by weight of the polytetrafluoroethylene particles.

Preparation of Electrostatic Charge Image Developing Toner

The electrostatic charge image developing toner according to an exemplary embodiment may be produced by mixing the toner particles and external additives, such as the specific PTFE particles and the specific silica particles, by using a Henschel mixer, a V blender or the like. Alternatively, when the toner particles are produced according to a wet method, a method in which the external additives are externally added by a wet process may be used.

Electrostatic Charge Image Developer

An electrostatic charge image developer according to the exemplary embodiment includes at least an electrostatic charge image developing toner according to the exemplary embodiment.

The electrostatic charge image developing toner according to the exemplary embodiment may be used as a single component developer, which is formed by the toner alone, or as a two component developer. When the toner is used in the two component developer, the toner is used in a mixture with a carrier.

Carriers that can be used in the two component developer are not particularly limited, and known carriers may be used.

The carrier may have an electrical resistivity in the range of from $1\times10^{7.5}$ Ω·cm (or about $1\times10^{7.5}$ Ω·cm) to $1\times10^{9.5}$ Ω·cm (or about $1\times10^{9.5}$ Ω·cm). Examples of the carrier include iron power, glass beads, ferrite power, and nickel powder, and a carrier obtained by providing the surface of a core material, which may be any of the above materials, with a resin coating.

In particular, a carrier that is composed of a core material and a resin coating formed on the surface of the core material is preferable from the viewpoint of maintaining the charging properties of the carrier.

In the carrier, the resin that covers the surface of the core material may include a fluororesin.

Resin particles and/or electrical conductive particles may be dispersed in the resin coating layer of the carrier.

The particle diameter of the carrier is in the range of preferably from 20 μm (or about 20 μm) to 60 μm (or about 60 μm), more preferably from 25 μm (or about 25 μm) to 45 μm (or about 45 μm), and still more preferably from 30 μm (or about 30 μm) to 40 μm (or about 40 μm).

In the exemplary embodiment, the mixing ratio of the electrostatic charge image developing toner and the carrier may be appropriately selected. In general, the mixing ratio (weight ratio) of the electrostatic charge image developing toner to the carrier (toner: carrier), is preferably in the range of from 1:100 to 30:100, and more preferably in the range of from 3:100 to 20:100.

Image Forming Apparatus

An image forming apparatus according to the exemplary embodiment in which the electrostatic charge image developing toner according to the exemplary embodiment is used is described below.

The image forming apparatus according to the exemplary embodiment includes: a latent image holding member; a developing unit that develops an electrostatic latent image formed on the latent image holding member into a toner image using a developer; a transfer unit that transfers the toner image formed on the latent image holding member to a transfer-receiving medium; a fixing unit that fixes the toner image that has been transferred onto the transfer-receiving medium; and a cleaning unit that removes deposits remaining after transfer by rubbing the latent image holding member with a cleaning member, and the electrostatic charge image developer according to the exemplary embodiments is used as the developer. An example of the image forming apparatus according to the exemplary embodiment is described below. However, the invention is not limited thereto. Descriptions are given only for main parts shown in the figures, and descriptions on the other parts are omitted.

In the image forming apparatus, for example, a portion that includes the developing unit may have a cartridge structure (process cartridge) that is attachable to and detachable from the image forming apparatus. As the process cartridge, a process cartridge according to the exemplary embodiment, which has at least a developer holder and stores the electrostatic charge image developer according to the exemplary embodiment, may be used.

FIG. 1 is a schematic configurational diagram showing a quadruple tandem type full-color image forming apparatus, which is an example of the image forming apparatus according to the exemplary embodiment. The image forming apparatus shown in FIG. 1 includes first to forth electrophotographic image forming units of 10Y, 10M, 10C, and 10K (image forming devices) that output images of the respective colors of yellow (Y), magenta (M), cyan (C), and black (K) based on color-separated image data. The image forming units (hereinafter, simply referred to as "unit(s)") 10Y, 10M, 10C and 10K are disposed in parallel at a predetermined distance from each other in a horizontal direction. The units 10Y, 10M, 10C and 10K may be process cartridges that are attachable to and detachable from the image forming apparatus.

At the upper side (in the drawing) of the respective units 10Y, 10M, 10C, and 10K, an intermediate transferring belt 20 as an intermediate transfer member is disposed to extend through the respective units, The intermediate transfer belt 20 is wound around a driving roller 22 and a support roller 24 that are disposed from right to left in the drawing, and are separated from each other. The support roller 24 is in contact with the inner surface of the intermediate transfer belt 20. The intermediate transfer belt 20 runs in the direction of from the first unit 10Y toward the forth unit 10K. The support roller 24 is pressed in the direction departing from the driving roller 22 by a spring or the like (not shown in the drawing) to provide a certain tension to the intermediate transfer belt 20 wound around the both rollers. On the photoreceptor side surface of the intermediate transfer belt 20, an intermediate transfer member cleaning unit 30 is disposed to oppose the driving roller 22.

Toners of four colors of yellow, magenta, cyan, and black that are stored in toner cartridges 8Y, 8M, 8C and 8K, respectively, can be supplied to developing units (development parts) 4Y, 4M, 4C and 4K of the respective units 10Y, 10M, 10C and 10K.

The above-described first to fourth units 10Y, 10M, 10C and 10K have equivalent configurations. Accordingly, the first unit 10Y, which forms a yellow image and is disposed on the upstream side in the running direction of the intermediate transfer belt, is described below as a representative thereof.

To portions equivalent to those of the first unit 10Y, reference marks provided with magenta (M), cyan (C) and black (K) are imparted in place of yellow (Y), and descriptions of the second to fourth units 10M, 10C and 10K are omitted.

The first unit 10Y has a photoreceptor 1Y that serves as a latent image holding member. Around the photoreceptor 1Y, the following components are sequentially disposed: a charging roller 2Y that charges the surface of the photoreceptor 1Y to a predetermined potential; an exposure device 3 that exposes the charged surface by a laser beam 3Y based on color-separated image signals to form an electrostatic latent image; a developing device (development unit) 4Y that supplies a charged toner to the electrostatic latent image to develop the electrostatic latent image; a primary transfer roller 5Y (primary transfer unit) that transfers the developed toner image onto the intermediate transfer belt 20; and a photoreceptor cleaning device 6Y (cleaning unit) that removes toner remaining on the surface of the photoreceptor 1Y after the primary transfer.

The primary transfer roller 5Y is disposed at the inner side of the intermediate transfer belt 20, at a position that opposes the photoreceptor 1Y. Bias power sources (not shown in the drawing) that apply primary transfer biases are connected to the respective primary transfer rollers 5Y, 5M, 5C and 5K. Each bias power source changes the transfer bias applied to the corresponding primary transfer roller by a controller (not shown).

An operation of forming a yellow image in the first unit 10Y is described below. Prior to the operation, the surface of the photoreceptor 1Y is charged to a potential of approximately from −600 V to −800 V by using a charging roller 2Y.

The photoreceptor 1Y is formed by superposing a photosensitive layer on a conductive base material (having a volume resistivity at 20° C. of $1\times10^{-6}$ Ω·cm or less). The photosensitive layer usually has a high resistance (comparable to the resistance of a usual resin), but has properties such that irradiation with a laser beam 3Y changes the specific resistance of a portion irradiated with the laser beam. The laser beam 3Y is outputted through an exposure device 3 onto a surface of the charged photoreceptor 1Y in accordance with yellow image data transmitted from a controller (not shown). The laser beam 3Y is irradiated on the photosensitive layer at the surface of the photoreceptor 1Y, thereby forming an electrostatic latent image for a yellow printing pattern on the surface of the photoreceptor 1Y.

The electrostatic latent image is an image formed by charging on the surface of the photoreceptor 1Y and is a negative latent image formed by the following manner: the specific resistance of the irradiated portion of the photosensitive layer is lowered by the laser beam 3Y, as a result of which the electric charges on the surface of the photoreceptor 1Y flow out while the electric charges on a portion that has not been irradiated by the laser beam 3Y remain thereon.

The electrostatic latent image thus formed on the photoreceptor 1Y is conveyed to a predetermined developing position owing to the rotation of the photoreceptor 1Y. Then, electrostatic latent image on the photoreceptor 1Y is visualized into a visual image (toner image) by a developing device 4Y at the developing position.

In the developing device 4Y, a yellow toner according to the exemplary embodiment is stored. The yellow toner is tribocharged by being stirred inside the developing device 4Y, and the yellow toner having an electric charges of the same polarity (negative polarity) as that of electric charges provided by charging on the photoreceptor 1Y is retained on a developer roll (developer holder). When the surface of the photoreceptor 1Y passes through the developing device 4Y, the yellow toner is electrostatically adhered onto a neutralized latent image portion on a surface of the photoreceptor 1Y, as a result of which the latent image is developed with the yellow toner. The photoreceptor 1Y with the thus formed yellow toner image run at a predetermined speed, and the toner image on the photoreceptor 1Y is conveyed to a predetermined primary transfer position.

When the yellow toner image on the photoreceptor 1Y is conveyed to the primary transfer position, a predetermined primary transfer bias is applied to a primary transfer roller 5Y, as a result of which an electrostatic force directing from the photoreceptor 1Y to the primary transfer roller 5Y works on the toner image, and the toner image on the photoreceptor 1Y is transferred onto an intermediate transfer belt 20. The applied transfer bias has polarity (+), which is opposite to the polarity (−) of the toner. For example, the transfer bias in the first unit 10Y is adjusted to approximately +10 μA by the controller (not shown in the figure).

On the other hand, the residual toner remaining on the photoreceptor 1Y is removed and recovered by the cleaning device 6Y.

Primary transfer biases applied to the primary transfer roller 5M, 5C and 5K in the second unit 10M and the units located further downstream are controlled in a manner similar to the control of the first unit.

The intermediate transfer belt 20 having the yellow toner image transferred in the first unit 10Y is conveyed sequentially through the second to fourth units of 10 M, 10C and 10K, and thereby toner images of the respective colors are transferred and superposed to achieve multiple transfer.

The intermediate transfer belt 20 on which toner images of four colors have been transferred by the first to fourth units reaches a secondary transfer portion that is formed by the intermediate transfer belt 20, a support roller 24 in contact with the inner surface of the intermediate transfer belt 20, and a secondary transfer roller 26 (secondary transfer unit) disposed at the image holding surface side of the intermediate transfer belt 20. On the other hand, a recording sheet (transfer-receiving medium) P is fed at a predetermined timing through a feeding mechanism, to between the secondary transfer roller 26 and the intermediate transfer belt 20 which are in pressure contact, and a predetermined secondary transfer bias is applied to the support roller 24. The applied transfer bias has the (−) polarity, which is the same as the polarity (−) of the toner. An electrostatic force directing from the intermediate transfer belt 20 to the recording sheet P is exerted on the toner image, thereby transferring the toner image on the intermediate transfer belt 20 to the recording sheet P. The applied secondary transfer bias is determined depending on the electric resistance detected by a resistance detection unit (not shown in the figure) that detects the resistance of the secondary transfer portion, and the voltage of the secondary transfer bias is controlled accordingly.

The recording sheet P is delivered to a fixing device (fixing unit) 28, at which the toner image is heated and the toner image, which is composed of superposed color toner images, is melted and fixed onto the recording sheet P. The recording sheet P after completion of the color image fixation is conveyed to a discharge section, and a series of color image forming operations is completed.

The image forming apparatus described above as an example has a configuration in which a toner image is transferred to the recording sheet P through the intermediate transfer belt 20. However, the image forming apparatus is not limited to this configuration, and may have a configuration in which a toner image is directly transferred from the photoreceptor to the recording paper.

Process Cartridge and Toner Cartridge

Figure 2:
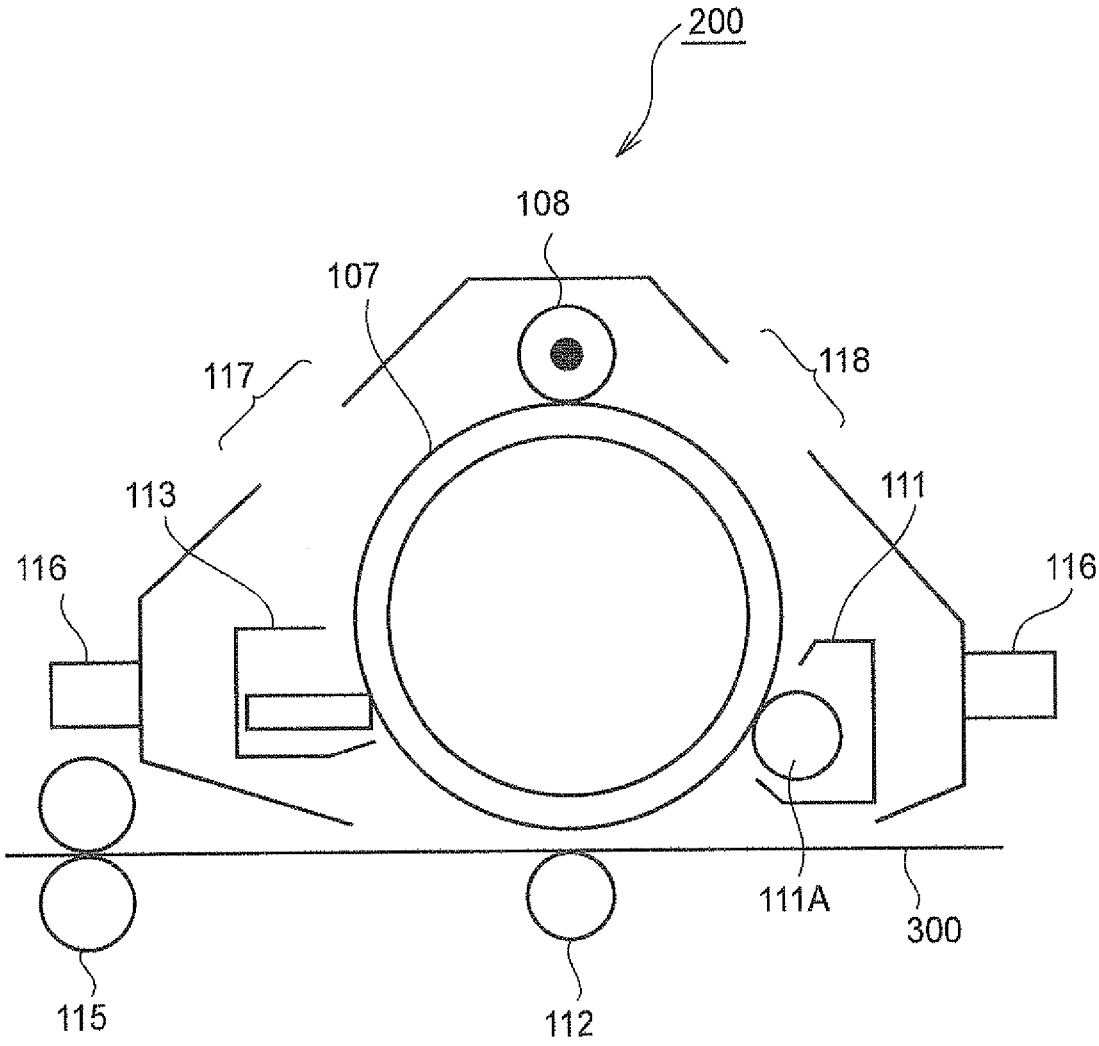
FIG. 2 is a schematic configurational diagram showing an example of a process cartridge according to an exemplary embodiment of the present invention.

FIG. 2 is a schematic configurational diagram showing an example of a process cartridge that stores an electrostatic charge image developer according to the exemplary embodiment. A process cartridge 200 is an assembly in which a photoreceptor 107, a charging roller 108, a developing device 111, a photoreceptor cleaning device (cleaning unit) 113, an opening 118 for light exposure, and an opening 117 for diselectrifying exposure are combined and integrated by a rail 116 for mounting. In FIG. 2, the reference character 300 represents a transfer-receiving medium, and the reference character 111A represents a developing roller.

The process cartridge 200 is designed to be attachable to and detachable from an image forming apparatus that is composed of a transfer device 112, a fixing device 115, and other constituent portion(s) (not shown).

The process cartridge shown in FIG. 2 is equipped with the charging roller 108, the cleaning device (cleaning unit) 113, the opening 118 for light exposure, and the opening 117 for diselectrifying exposure. However, the process cartridge may include a combination of components that are arbitrarily selected from these members and devices.

The process cartridge according to the exemplary embodiment may include, besides the photoreceptor 107 and the developing device 111, at least one selected from the group consisting of a charging roller 108, a photoreceptor cleaning device (cleaning unit) 113, an opening 118 for light exposure, and an opening 117 for diselectrifying exposure.

A toner cartridge according to the exemplary embodiment is described below.

The toner cartridge according to the exemplary embodiment is a toner cartridge that is attachable to and detachable from an image forming apparatus and stores a toner to be supplied to a developing device disposed in the image forming apparatus. As the toner, the electrostatic charge image developing toner according to the exemplary embodiment is used. The toner cartridge according to the exemplary embodiment stores at least the electrostatic charge image developing toner according to the exemplary embodiment. For example, a developer may also be stored in the toner cartridge, depending on the mechanism of the image forming apparatus.

Accordingly, in the image forming apparatus that has a configuration in which a toner cartridge is attachable to and detachable from, the electrostatic charge image developing toner according to the exemplary embodiment is easily supplied to a developing device by using the toner cartridge that stores the electrostatic charge image developing toner according to the exemplary embodiment.

The image forming apparatus shown in FIG. 1 has a configuration such that toner cartridges 8Y, 8M, 8C and 8K are attachable to and detachable from the image forming apparatus. The developing devices 4Y, 4M, 4C and 4K are connected to the toner cartridges for the respective developing devices (colors) through toner supply tubes (not shown). When the toner stored in a toner cartridge becomes scarce, the toner cartridge may be replaced.

EXAMPLES

The exemplary embodiment is more specifically described in detail below with reference to Examples and Comparative Examples. However, the exemplary embodiment is not limited to these Examples. In the following, "part(s)" represents "part(s) by weight" unless indicated otherwise.

Examples 1 to 8 and Comparative Examples 1 to 4

Preparation of Toner Particles 1

Preparation of Polyester Resin Dispersion Liquid

| | |
|---|---|
| Terephthalic acid | 30 mol % |
| Fumaric acid | 70 mol % |
| Bisphenol A ethyleneoxide 2 mol adduct (an adduct in which the molar number of ethylene oxide units is twice the molar number of bisphenol A) | 20 mol % |
| Bisphenol A propyleneoxide adduct | 80 mol % |

The above monomers are charged in a flask that has an internal capacity of 5 L and that is equipped with a stirrer, a nitrogen gas inlet tube, a temperature sensor, and a rectifying column. The temperature of the resulting reaction mixture is elevated to 190° C. over 1 hour. After it is confirmed that the reaction mixture is uniformly stirred, 1.2 parts by weight of dibutyltin oxide are added thereto. Further, the temperature is elevated from 190° C. to 240° C. over 6 hours while generated water is distilled away. The dehydration condensation reaction is allowed to further continue for 3 hours at 240° C., as a result of which a polyester resin 1 having an acid value of 12.0 mg/KOH and a weight average molecular weight of 9,700 is obtained.

Then, the obtained polyester resin is transferred, in the melted state, to CAVITRON CD1010 (trade name, manufactured by Eurotec Co., Ltd.) at a rate of 100 g per minute. Into a separately-prepared tank for an aqueous medium, a dilute ammonia water having a concentration of 0.37% by weight, which is prepared by diluting a reagent ammonia water with ion-exchanged water, is added. While heated at 120° C. with a heat exchanger, the dilute ammonia water is transferred to the CAVITRON CD1010 (trade name, manufacture by Eurotec Co., Ltd.) at a rate of 0.1 L per minute simultaneously with the transferring of the melted polyester resin 1, which is non-crystalline, to the CAVITRON CD1010.

The CAVITRON is operated at a rotator rotating speed of 60 Hz and a pressure of 5 kg/cm$^2$, as a result of which a polyester resin dispersion liquid having a solid content of 30% is obtained. The polyester resin dispersion liquid includes the non-crystalline polyester resin, and the average particle diameter thereof is 0.16 μm.

Preparation of Colorant Dispersion Liquid

| | |
|---|---|
| Cyan pigment (Copper Phthalocyanine B15:3, manufactured by Dainichiseika Color & Chemicals Mfg. Co., Ltd.) | 45 parts |
| Anionic surfactant "NEOGEN RK" (trade name, manufactured by Daiichi Kogyo Seiyaku Co., Ltd.) | 5 parts |
| Ion-exchanged water | 200 parts |

The above components are mixed, and dispersed by using a homogenizer ("IKA ULTRA-TURRAX" (trade name)) for 10 minutes, as a result of which a colorant dispersion liquid having a median particle diameter of 168 nm and a solid content of 22.0% is obtained.

Preparation of Release Agent Dispersion Liquid

| | |
|---|---|
| Paraffin wax HNP9 (trade name, manufactured by Nippon Seiro Co., Ltd., melting point 75° C.) | 45 parts |
| Anionic surfactant "NEOGEN RK" (trade name, manufactured by Daiichi Kogyo Seiyaku Co., Ltd.) | 5 parts |
| Ion-exchanged water | 200 parts |

The above components are heated at 95° C. and dispersed sufficiently by using ULTRA-TURRAX T50 (trade name) manufactured by IKA Japan K.K., and then subjected to dispersion treatment by using a pressure-ejection type Gaulin Homogenizer, as a result of which a release agent dispersion liquid having a median particle diameter of 200 nm and a solid content of 20.0% by weight is obtained.

Preparation of Toner Particles 1

| | |
|---|---|
| Polyester resin dispersion liquid | 292.2 parts |
| Colorant dispersion liquid | 26.3 parts |
| Release agent dispersion liquid | 34 parts |

The above dispersion liquids are mixed and dispersed sufficiently by using a ULTRA-TURRAX T50 in a round-bottom stainless-steel flask. Then, 0.25 parts by weight of polyaluminum chloride is further added, and dispersing operation by using the ULTRA-TURRAX is continued. The contents of the flask are heated to 48° C. in a heating oil bath while stirring. After the temperature of the contents of the flask is maintained at 48° C. for 60 minutes, 70.0 parts of the polyester resin dispersion liquid are gently added thereto.

Thereafter, the pH inside the reaction system is adjusted to 9.0 with a 0.5 mol/l sodium hydroxide aqueous solution. Then, the stainless-steel flask is hermetically sealed, and the contents thereof are heated to 96° C. while stirring with a magnetic seal is continued, and the contents of the flask are maintained in that state for 5 hours.

After the reaction comes to completion, the contents of the flask are cooled and filtrated, and the matter collected by the filtration is washed with ion-exchanged water sufficiently, and is subjected to solid-liquid separation using a nutche-type suction filtration. The obtained solid is re-dispersed using 1 L of ion-exchanged water having a temperature of 40° C., and the obtained dispersion liquid is stirred at 350 rpm for 18 minutes for washing.

The above washing process is further repeated five times. When the pH of the filtrate becomes 7.5 and the electrical conductivity thereof becomes 7.0 μS/cm, solid-liquid separation is conducted by a nutche suction filtration, using a No. 5A filter paper. Then, vacuum drying is continued for 12 hours.

The particle diameter of the obtained particles is measured, and the volume average particle diameter D50 is 6.1 μm. Based on a particle shape observation with a LUZEX (trade name), the shape factor of the particles is found to be 128.

Preparation of Toner Particles 2

| | |
|---|---|
| Polyester resin (Terephthalic acid/bisphenol A ethylene oxide adduct, average molecular weight Mw: 12,000, Tg: 65° C., softening point: 100° C.) | 95 parts |
| Colorant (Copper Phthalocyanine Blue C.I. Pigment Blue 15:3) | 5 parts |

The above components are preliminary mixed by using a Henschel mixer, and the resulting mixture is kneaded under heat by using an extruder at a temperature set at 145° C. After the mixture is cooled, the mixture is roughly pulverized, and is finely pulverized by using a jet mill. The particle diameter of the obtained particles is measured, and the volume average particle diameter D50 is found to be 6.2 μm. Further, the pulverized particles are classified, and the obtained classified particles have a volume average particle diameter D50 of 6.6 μm and contain particles having a particle diameter of 5 μm or less at a ratio of 22 vol. %. Based on a particle shape observation with LUZEX (trade name), the shape factor of the particles is found to be 145.

Preparation of External Additives

1. Preparation of PTFE Particles (1-1) Preparation of PTFE Particles 1

In an autoclave equipped with a stainless steel anchor-type stirring propeller and a temperature controlling jacket, 3.5 L of deionized water are charged. The inside of the autoclave is purged with nitrogen gas and tetrafluoroethylene (hereinafter, referred to as "TFE") while heating, and then 1.0 g of ethane is injected by pressure using TFE. The deionized water is stirred at 500 rpm while the inside temperature is maintained at 80° C. An aqueous solution obtained by dissolving 400 mg of ammonium persulfate in 25 mL of de-ionized water is injected by pressure using TFE. The supply of the TFE is performed in such a manner that the inside pressure is maintained constant. The temperature is controlled to be 90° C., and the stirring rate is regulated to be 550 rpm. After 1 hour stirring, nitric acid is added in an amount of 1 g per 500 g of the PTFE dispersion liquid, and, at the same time, coagulation is started at a stirring rate of 600 rpm to separate the polymer from water. Thereafter, stirring is performed for 1 hour, and then water is removed. The polymer is then dried, as a result of which PTFE particles 1 are obtained. The amount of PFOA contained in the PTFE particles 1 is 0 ppm.

(1-2) Preparation of PTFE Particles 2

The same procedures as those in the preparation of the PTFE particles 1 are performed up until coagulation except that 200 mg of ammonium perfluorooctanoate are charged in the autoclave. As a result, an aqueous solution is obtained. 500 g of the obtained aqueous solution and 500 g of a mixed solvent of $CF_2ClCF_2CHClF$ and $CF_3CF_2CHCl_2$ are charged in a separatory funnel. After vigorous stirring, the mixture is left for 3 hours, and then subjected to extraction. This extraction procedure is repeated three times, followed by drying. Thereafter, the resulting powder is dried, and then washed with water and dried again, as a result of which PTFE particles 2 are obtained. The amount of PFOA contained in the PTFE particles 2 is 0.5 ppm.

(1-3) Preparation of PTFE Particles 3

PTFE particles 3 are obtained in the same manner as the preparation of the PTFE particles 2, except that extraction is performed with $CHF_2CH_2CF_3$. The amount of PFOA contained in the PTFE particles 3 is 0.6 ppm.

The amount of perfluorooctanoic acid that is contained in the PTFE particles used in each Example or Comparative Example is measured according to the measurement method described above. The measurement results are shown in Table 1.

2. Preparation of Specific Silica Particles (1-1) Preparation of Specific Silica Particles 1

Commercially available silica particles (HDK H2000 (trade name), manufactured by Wacker Chemie AG) that are prepared by a gas phase method are used. The silica particles are stored in a vacuum drier for 12 hours, and are used as silica particles 1, which are specific silica particles. The water content of the silica particles 1 is 0.1% by weight.

(1-2) Preparation of Silica Particles 2

55 parts of 25% by weight ammonia water are dripped on 1000 parts of tetramethoxysilane over 3 hours at 30° C. in the presence of 35 parts of ion-exchanged water and 500 parts of methanol while stirring at 150 rpm. The silica sol suspension obtained through the above reaction is heated to 85° C. to remove methanol. Toluene is added thereto, and the suspension is heated to 100° C. to remove ammonia and water. Further, the separated wet silica gel is dried at 120° C. for 2 hours. Then, hexamethyl disilazane is added to the silica at a ratio of 60 parts of hexamethylene disilazane per 100 parts of the silica, and stirring is further continued for 4 hours, Finally, the temperature is elevated to 90° C. so as to evaporate ethanol under vacuum. The treated product is taken out, and further dried under vacuum at 120° C. for 5 hours. The resulting dried silica is pulverized, thereby providing silica particles 2, which are specific silica particles. The water content of the silica particles 2 is 5.6% by weight.

(1-3) Preparation of Silica Particles 3

55 parts of 25% by weight ammonia water are dripped on 1000 parts of tetramethoxysilane over 3 hours at 30° C. in the presence of 35 parts of ion-exchanged water and 500 parts of methanol while stirring at 150 rpm. The silica sol suspension obtained through the above reaction is heated at 85° C. to remove methanol. Toluene is added thereto, and the suspension is heated to 100° C. to remove ammonia and water. Further, the separated wet silica gel is dried at 120° C. for 2 hours. Then, hexamethyl disilazane is added to the silica at a ratio of 50 parts of hexamethyl disilazane per 100 parts of silica, and stirring is further continued for 3 hours. The temperature is elevated to 90° C. so as to evaporate ethanol under vacuum. The treated product is taken out, and further dried under vacuum at 120° C. for 5 hours. The resulting dried silica is pulverized and subjected to humidity control in the air at a temperature of 30° C. and a humidity of 80% for 2 hours while stirring, thereby providing silica particles 3, which are specific silica particles. The water content of the silica particles 3 is 9.8% by weight.

(1-4) Preparation of Silica Particles 4

Commercially available silica particles (HDK H2000 (trade name), manufactured by Wacker Chemie AG) that are prepared by a gas phase method are used. These silica particles are stored at 30° C. and 80% RH for 48 hours, and are used as silica particles 4, which are specific silica particles. The water content of the silica particles 4 is 1.3% by weight.

(1-5) Preparation of Silica Particles 5

Silica particles 5 are obtained in the same manner as the (1-3) preparation of silica particles 3, except that the humidity control time is changed to 5 hours. The water content of the silica particles 5 is 10.4% by weight.

The water content (percentage of water) of silica particles used in each Example or Comparative Example is measured according to the measurement method described above. The measurement results are shown in Table 1.

Preparation of Toner (Electrostatic Charge Image Developing Toner)

Toner 1

0.4 parts of the PTFE particles and 2.0 parts of the specific silica particles that are described in Table 1 are added to 100 parts of the toner particles 1, and are blended with a Henschel mixer at 800 rpm for 20 minutes, as a result of which toner 1 is obtained.

Toners 2 to 12

Toners 2 to 12 are obtained in the same manner as the preparation of the toner 1, except that the kind of the toner particles and the kinds of the PTFE particles and the silica particles as external additives are changed as described in Table 1.

Preparation of Carrier

| | |
|---|---|
| Ferrite particles (volume average particle diameter: 50 μm, volume electrical resistivity: 3 × 108 Ω · cm) | 100 parts |
| Toluene | 14 parts |
| Copolymer of perfluorooctylethyl acrylate and methyl methacrylate (copolymerization ratio = 40:60, Mw = 80,000) | 1.6 parts |
| Carbon black (VXC-72 (trade name), manufactured by Cabot Corp.) | 0.12 parts |

The above components except the ferrite particles are dispersed by using a stirrer for 10 minutes so as to prepare a liquid for forming a resin coating. The liquid for forming a resin coating and the ferrite particles are charged in a vacuum deairing kneader and stirred at 60° C. for 30 minutes. Thereafter, toluene is distilled away under vacuum so as to form a resin coating on the surface of the ferrite particles, whereby a carrier is obtained.

Preparation of Developer

The toner 1 in an amount of 5 parts by weight and the carrier in an amount of 100 parts by weight are stirred by using a V-type blender at 40 rpm for 10 minutes, as a result of which developer 1 of Example 1 is prepared.

In the same manner as the preparation of developer 1, developers 2 to 12 are obtained by mixing each of the toners 2 to 12 and the carrier.

The resulting developers 1 to 12 are used in Examples 1 to 8 and Comparative Examples 1 to 4, respectively.

Evaluation

1. Color Streak Evaluation

Evaluation using an actual machine is performed. Specifically, a 20×20 cm image at a toner amount of 6.0 g/cm$^2$ is formed on a A4 size plain paper (C2 paper, manufactured by Fuji Xerox Co., Ltd.), using a modified machine of DocuCenterColor 400 (trade name, manufactured by Fuji Xerox Co., Ltd.) in a low humidity environment of 20° C. and a relative humidity of 15%. In the evaluation, 10 kpv (kilo print volume) continuous printing (image output on 10,000 sheets) is performed. While printing, the generation of color streaks in an image portion is observed with naked eyes every 1,000 sheets. The evaluation criteria are as follows. The evaluation results are shown in Table 1.

Evaluation Criteria

A: Color streak is not observed.

B: Color streaks are slightly observed.

C: Color streaks are observed, but they are at a minimum tolerable level.

D: Color streaks are observed.

2. Evaluation on Abrasion of Photoreceptor

Abrasion of photoreceptor is evaluated as follows. Specifically, a 20×20 cm image at a toner amount of 6.0 g/cm$^2$ is formed on a A4 size plane paper (C2 paper, manufactured by Fuji Xerox Co., Ltd.), using a modified machine of DocuCenterColor 400 (trade name, manufactured by Fuji Xerox Co., Ltd.) in a low humidity environment of 20° C. and a relative humidity of 15%. In the evaluation, 10 kpv continuous printing (image output on 10,000 sheets) is performed. The abrasion amount of the photoreceptor is measured every 1,000 sheets. More specifically, abrasion amounts are measured at a total of 80 measurement points (4 measurement points arranged in a circumferential direction×20 measurement points arranged in the main axis direction), and the average thereof is used as the abrasion amount of the photoreceptor. Uneven abrasion is also measured according to the formula $$\text{Uneven abrasion} = \text{maximum abrasion amount} - \text{minimum abrasion amount}$$

The measurement of the abrasion amount is performed using an eddy-current thickness meter.

The evaluation criteria are as follows. The evaluation results are shown in Table 1.

Evaluation Criteria

A: The abrasion amount is less than 10 nm/kcycle, and the uneven abrasion is less than 2 nm/kcycle.

B: The abrasion amount is from 10 nm/kcycle to less than 20 nm/kcycle, and the uneven abrasion is less than 2 nm/kcycle.

C: The abrasion amount is from 10 nm/kcycle to less than 20 nm/kcycle, and the uneven abrasion is 2 nm/kcycle or more.

D: The abrasion amount is 20 nm/kcycle or more, and the uneven abrasion is 2 nm/kcycle or more.

TABLE 1

| | | | External additives | | | | | |
|---|---|---|---|---|---|---|---|---|
| | | | PTFE particles | | Silica particles | | Evaluation | |
| | Developer No. | Toner particles | Type | Perfluorooctanoic acid amount (ppm) | Type | Percentage of water (% by weight) | Color streaks | Abrasion evaluation |
| Example 1 | Developer 1 | Toner particles 1 | 1 | 0 | 1 | 0.1 | B | A |
| Example 2 | Developer 2 | Toner particles 1 | 1 | 0 | 2 | 5.6 | A | A |
| Example 3 | Developer 3 | Toner particles 1 | 1 | 0 | 3 | 9.8 | B | B |
| Example 4 | Developer 4 | Toner particles 1 | 2 | 0.5 | 1 | 0.1 | B | B |
| Example 5 | Developer 5 | Toner particles 1 | 2 | 0.5 | 4 | 1.3 | B | A |
| Example 6 | Developer 6 | Toner particles 1 | 2 | 0.5 | 3 | 9.8 | B | B |
| Example 7 | Developer 7 | Toner particles 2 | 1 | 0 | 2 | 5.6 | A | B |
| Example 8 | Developer 8 | Toner particles 2 | 2 | 0.5 | 4 | 1.3 | B | A |
| Comparative Example 1 | Developer 9 | Toner particles 1 | 3 | 0.6 | 1 | 0.1 | C | B |
| Comparative Example 2 | Developer 10 | Toner particles 1 | 3 | 0.6 | 2 | 5.6 | C | B |
| Comparative Example 3 | Developer 11 | Toner particles 1 | 3 | 0.6 | 3 | 9.8 | D | C |
| Comparative Example 4 | Developer 12 | Toner particles 1 | 1 | 0 | 5 | 10.4 | C | D |

FIG. 1 shows clearly that uneven abrasion of the photoreceptor and generation of color streaks are suppressed by using the toner according to the exemplary embodiment. In addition, the abrasion amount of the photoreceptor is also suppressed by using the toner according to the exemplary embodiment.

The foregoing description of the exemplary embodiments has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles comprising a binder resin and a colorant;

polytetrafluoroethylene particles in which a content of perfluorooctanoic acid and a salt thereof is 0.5 ppm or less; and silica particles in which a content of water is from 0.1% by weight (or about 0.1% by weight) to 10% by weight (or about 10% by weight) at an ambient temperature of 20° C. and an ambient humidity of 20%.

2. The electrostatic charge image developing toner according to claim 1, wherein an average particle diameter of the polytetrafluoroethylene particles is from 100 nm (or about 100 nm) to 500 nm (or about 500 nm).

3. The electrostatic charge image developing toner according to claim 1, wherein an addition amount of the polytetrafluoroethylene particles is from 0.1 parts by weight (or about 0.1 parts by weight) to 1 part by weight (or about 1 part by weight) with respect to 100 parts by weight of the toner particles.

4. The electrostatic charge image developing toner according to claim 1, wherein the polytetrafluoroethylene particles are produced by an emulsion polymerization method.

5. The electrostatic charge image developing toner according to claim 1, wherein a number average particle diameter of the silica particles is from 0.005 μm (or about 0.005 μm) to 0.50 μm (or about 0.50 μm).

6. The electrostatic charge image developing toner according to claim 1, wherein the silica particles are hexamethyldisilazane-treated silica particles.

7. The electrostatic charge image developing toner according to claim 1, wherein the content ratio of the silica particles to the polytetrafluoroethylene particles is from 0.5 parts by weight (or about 0.5 parts by weight) to 30 parts by weight (or about 30 parts by weight) of the silica particles with respect to 1 part by weight of the polytetrafluoroethylene particles.

8. The electrostatic charge image developing toner according to claim 1, wherein the binder resin is a polyester resin.

9. The electrostatic charge image developing toner according to claim 1, wherein a volume average particle diameter of the toner is from 2 μm (or about 2 μm) to 12 μm (or about 12 μm).

10. The electrostatic charge image developing toner according to claim 1, wherein a shape factor SF1 of the toner is from 115 (or about 115) to 140 (or about 140).

11. An electrostatic charge image developer comprising:

the electrostatic charge image developing toner according to claim 1; and a carrier.

12. The electrostatic charge image developer according to claim 11, wherein the carrier is a resin-coated carrier having a resin coating on the surface thereof.

13. The electrostatic charge image developer according to claim 12, wherein carbon black is contained in a resin of the resin-coated carrier.

14. The electrostatic charge image developer according to claim 11, wherein the carrier has an electrical resistivity of from $1\times10^{7.5}$ Ω·cm (or about $1\times10^{7.5}$ Ω·cm) to $1\times10^{9.5}$ Ω·cm (or about $1\times10^{9.5}$ Ω·cm).

15. The electrostatic charge image developer according to claim 11, wherein the carrier has a particle diameter of from 20 μm (or about 20 μm) to 60 μm (or about 60 μm).

16. A process cartridge comprising a developer holder and storing the electrostatic charge image developer according to claim 11.

17. An image forming apparatus comprising:

a latent image holding member;

a developing unit that develops an electrostatic latent image formed on the latent image holding member as a toner image using an electrostatic charge image developer according to claim 11;

a transfer unit that transfers the toner image formed on the latent image holding member to a transfer-receiving medium;

a fixing unit that fixes the toner image that has been transferred onto the transfer-receiving medium; and a cleaning unit that removes deposits remaining after transfer by rubbing the latent image holding member with a cleaning member.

18. A toner cartridge being attachable to and detachable from an image forming apparatus and storing a toner to be supplied to a developing unit disposed inside of the image forming apparatus, the toner being the electrostatic charge image developing toner according to claim 1.

* * * * *